US005203189A

United States Patent [19]

Lovejoy et al.

[11] Patent Number: 5,203,189

[45] Date of Patent: Apr. 20, 1993

[54] HIGH-INTENSITY ROTO PEEN FLAPS, METHOD OF MAKING SAME, WHEELS INCORPORATING SAME, AND METHODS OF USING WHEELS INCORPORATING SAME

[75] Inventors: Michael W. Lovejoy, Prescott, Wis.; Jennifer L. Trice, Eagan, Minn.; Richard C. Kerr, Rutherfordton, N.C.; John R. Damewood; Jill R. Menzel, both of Spartanburg, S.C.; Eddie L. Jarvis, Charlotte, N.C.; Bert A. Ross, Conyngham, Pa.

[73] Assignee: Minnesota Mining and Manufacturing Company, St. Paul, Minn.

[21] Appl. No.: 788,550

[22] Filed: Nov. 6, 1991

[51] Int. Cl.[5] ..... B21J 5/00

[52] U.S. Cl. ..... 72/53; 51/334; 51/402

[58] Field of Search ..... 72/53; 51/332, 334, 51/337, 401, 402

[56] References Cited

U.S. PATENT DOCUMENTS

| | | | |
|---|---|---|---|
| 3,638,464 | 2/1972 | Winter et al. | 72/53 |
| 3,778,241 | 12/1973 | Winter et al. | 161/87 |
| 3,834,200 | 9/1974 | Winter | 72/53 |
| 3,857,750 | 12/1974 | Winter et al. | 161/87 |
| 5,001,208 | 3/1991 | Ross et al. | 528/61 |
| 5,013,811 | 5/1991 | Ross | 528/60 |

FOREIGN PATENT DOCUMENTS

90/11329 10/1990 PCT Int'l Appl. .

OTHER PUBLICATIONS

Technical Product Brochure 61-5000-5990-4 (1282) II, "3M Brand Heavy Duty Roto Peen", published Dec., 1988.

Operating Instructions No. 34-7017-9636-8, "3M Heavy Duty Roto Peen Flap Wheel Operating Instructions", published Dec., 1988.

*Primary Examiner*—David Jones

*Attorney, Agent, or Firm*—Gary L. Griswold; Walter N. Kirn; Jeffrey L. Wendt

[57] ABSTRACT

An improved high-intensity roto-peen flap, constructed of coated fabric material, the coating including a plurality of layers at least one of which comprises a linear polyurethane elastomer, exhibits improved life over previous high-intensity roto peen flaps. A method of making such a flap, a wheel incorporating at least one of the flaps, and a method of high-intensity roto-peening using the wheel are also presented.

63 Claims, 3 Drawing Sheets

HIGH-INTENSITY ROTO PEEN FLAPS, METHOD OF MAKING SAME, WHEELS INCORPORATING SAME, AND METHODS OF USING WHEELS INCORPORATING SAME

CROSS REFERENCE TO RELATED APPLICATIONS

This application is related to U.S. application Ser. Nos. 07/788,498 and 07/788,653, filed Nov. 6, 1991, simultaneously with the present application.

TECHNICAL FIELD

The present invention relates to high-intensity roto (rotary) peening products which are made using an improved coated fabric as flap material which extends the service life of the flaps.

BACKGROUND ART

In the early 1970's a significant improvement over the then conventional shot peening process (wherein spheroidal particles are blown at high velocity against a surface to be treated) was introduced by Winter et. al., and embodied in the roto peening devices such as those disclosed in U.S. Pat. Nos. 3,638,464 and 3,834,200. Both of these patents are assigned to the assignee of the present application and are incorporated herein by reference where necessary to understand the present invention. The latter patent discloses a high-intensity peening flap construction which includes an elongate strap of a flexible, tear-resistant material, and at least one metal peening particle support base fastened to the elongate strap. A plurality of refractory-hard, impact fracture-resistant peening particles are metallurgically joined to an exposed face of the support base. In use, one or more of the flaps are mounted on a hub, and the hub is rotated while the flaps are forced against the workpiece to be peened. The peening particles on each support base strike the workpiece in turn, thereby causing the peening particles to perform their normal peening function, but preventing the normal uncontrolled scattering which occurs in conventional shot peening. FIG. 1, discussed in more detail hereinbelow, shows a later version of the flap/hub construction, such as currently marketed by assignee, and shown in assignee's technical bulletin no 61-5000-5490-4(1282)II, published December, 1988.

Winter et. al. found that by inclining the peening faces of the support bases to the length of the strap in the static condition required less deformation of the strap to cause impact of the peening particles normal to the surface being peened. While this configuration significantly reduces wear on the strap material immediately around the support bases, in particularly harsh (abrasive) operating conditions, for example where the workpiece itself is abrasive, the flaps fail. Adjacent flaps tend to impact each other when one flap is impinging on the workpiece, especially when many flaps are used on one wheel, where the flap immediately trailing the impinging flap is unhindered in it forward motion. Hence, the strap material suffers less than optimal life due to self-impact. Where the peening action generates particles of workpiece material, the particles can contribute to strap wear by being sandwiched momentarily between adjacent flaps.

Devices such as those discussed herein above have used as the flap material a polyurethane impregnated nylon scrim, for example, the polyester polyurethane coated nylon fabric sold under the trade name "Reevecoat 7625" available from Reeves Brothers, Inc., with offices at New York, NY. Effective though it is for many purposes, the polyester polyurethane impregnated nylon scrim material exhibits poor flex fatigue characteristics and insufficient abrasion resistance. Thus, an unmet need exists for a high-intensity peening flap construction which can withstand harsh operating conditions and provide improved abrasion resistance (longer useful life) over previously known constructions.

Polycarbonate-polyether polyurethanes are known in the polymer coating industry. One polycarbonate-polyether polyurethane is sold under the trade name "Morthane CA-1225" (Morton International) and comprises the reaction product of a mixture of polycarbonate polyol and polyether polyols; a diisocyanate compound; and first and second extenders. U.S. Pat. No. 5,001,208 provides a more detailed description of these polyurethanes and their method of manufacture, and is expressly incorporated herein by reference thereto Linear polyurethane elastomers made using polycarbonate-polyether polyurethanes are also disclosed. However, neither the polycarbonate-polyether polyurethanes of U.S. Pat. No. 5,001,208, nor the linear polyurethane elastomers made therefrom have been suggested for use in high-intensity roto peening operations or devices.

SUMMARY OF THE INVENTION

In accordance with the present invention, improved high-intensity peening flap constructions are presented which afford increased flap life over previous constructions. A roto peening wheel incorporating at least one of the flaps is presented, as well as methods of making the flap and using such a wheel.

As used herein, "high-intensity peening" is meant to include peening operations such as stress-relieving of metals, surface conditioning operations such as cleaning and descaling (i.e. removal of oxide scales and/or paint) of metals, creation of anti-slip surfaces, and surface conditioning of concrete.

One aspect of the invention presents an improved high-intensity peening flap of the type in which an elongate strap made of fabric having a coating thereon has at least one peening particle support base fastened thereto, the support base having a plurality of peening particles joined to an exposed face of the support base, wherein the improvement comprises said coating comprising a plurality of coating layers, at least one of the layers being comprised of a linear polyurethane elastomer.

The elongate strap is a fabric substrate which is coated with a plurality of layers, at least one of the layers including a linear polyurethane elastomer. Each of the layers can include one or more coats of the desired linear polyurethane elastomer, preferably applied by a three-head coating machine.

The preferred linear polyurethane elastomer is a polycarbonate-polyether polyurethane which is the reaction product of a mixture of a polycarbonate polyol and a polyether polyol, a diisocyanate compound, and first and second extenders. The first extender preferably has a molecular weight of less than about 500, and the diisocyanate compound is initially reacted with the first extender in a molar ratio of diisocyanate to first extender of above about 2:1 to form a modified diisocyanate component having a functionality of about 2 prior to reaction with the other components. The modified diisocyanate component provides relatively low temperature processing properties to the composition, whereas the polyol mixture provides superior hydrolytic stability and low temperature flexibility to the composition. The polyurethane may also be crosslinked to provide a stiffer coated fabric by adding a crosslinking agent such as an organic isocyanate compound having an isocyanate functionality of 2 or more.

At least a portion of the fabric substrate may include, as an initial layer, a pretreatment chemical to assist in the bonding of the coating layers thereto. This pretreatment chemical is preferably an aziridine compound. If desired, the fabric substrate and initial layer are heated prior to application of the urethane coating to further increase the degree of adhesion provided by the aziridine compound. Also, one or more of the layers may include a silicone compound in an amount effective to increase the tear resistance of the coated fabric.

At least one of the layers includes a second polymer such as a different or the same polyurethane or a different elastomer. The polyurethane of the second polymer may be a polyester polyurethane, and may further include a crosslinking agent such as an organic isocyanate compound having an isocyanate functionality of at least 2, to increase the stiffness of the coated fabric. Instead of a second polyurethane, an elastomer of natural, nitrile or neoprene rubber may be used.

While it is preferable to utilize a polyester polyurethane which has a durometer hardness of 90 Shore A or greater as the second polymer, this material can be used alone in certain severe use applications instead of the polyether-polycarbonate polyurethane described above. If desired, a crosslinking agent may be included to increase the stiffness of coated fabrics which include this polyester polyurethane.

The fabric substrate preferably has a weight of between about 180 and 415 grams per square meter; and more preferably between about 215 and 360 grams per square meter. Also, the fabric substrate may be woven, and may be comprised of nylon or polyester fiber, either as filament or spun yarn.

If desired, at least one of the layers, preferably the outermost layer, is calendered, and this calendered layer preferably includes the linear polyurethane elastomer. Also, the calendered layer may include a millable linear polyurethane elastomer in an amount sufficient to reduce the processing temperature of the layer by at least 6° C., to assist in the calendaring operation. If desired, a vulcanizing agent comprised of sulfur and other sulfur-based compounds can be included for increasing the tensile strength of the millable linear polyurethane elastomer by vulcanizing.

Preferred flap constructions are those having one or more of the following: internal and external wear pads, internal and external support straps, and a fin extending from an external support strap on the trailing side of the flap, all of which may be comprised of the preferred elongate strap material or different material.

Another aspect of the invention is an improved rotary peening wheel of the type having a hub and at least one peening flap removably fastened to the hub. The flap includes an elongate strap having the features as previously described, wherein the improvement lies in the use of a linear polyurethane elastomer in at least one of the coating layers. Preferred are those wheels having flaps made of an elongate strap wherein the linear polyurethane elastomer is the reaction product of a mixture of polycarbonate polyol and polyether polyols, a diisocyanate, and first and second extenders, as described above. Also preferred are those wheels utilizing flaps having internal and external support straps, internal and/or external wear pads, and fins, as described herein.

Yet another aspect of the invention is a method of making a rotary peening flap. The method, in its broadest description, includes the steps of (a) fastening at least one peening particle support base to an elongate strap of fabric having a coating thereon, the elongate strap having first and second ends and an intermediate portion, the coating having a plurality of coating layers, at least one of the layers comprising a linear polyurethane elastomer; and (b) overlapping and fastening the first and second ends to the intermediate portion of the elongate strap with fastening means.

Preferred are those methods utilizing the linear polyurethane elastomer described, as well as those methods wherein prior to step (a) either one or more of the following are positioned to be fastened: exterior and/or interior support straps, internal and/or external wear pads, and a trailing fin. Also preferred are those methods wherein the elongate strap is at least partially slit (either before steps (a) and (b) or after steps (a) and (b)) at one or more locations sufficient to provide multiple sub-flaps.

Still another aspect of the invention is an improved method of high-intensity rotary peening of workpieces including concrete, coated and uncoated metals, rivet or screw heads, preparing skid-proof surfaces, and stress relieving metals. The method is of the type which includes forcing a hub loaded with at least one peening flap against a workpiece having a surface to be peened. The flap is constructed as described, with the improvement lying in the use of a plurality of coating layers, at least one of the coating layers comprised of a linear polyurethane elastomer. Preferred methods include those utilizing linear polyurethane elastomer formed as described, as well as methods using flaps having one or more of the following: interior and/or exterior support straps, interior and/or exterior wear pads, and a trailing fin.

Other aspects and advantages of the invention will become apparent from the drawing, examples, and description which follows.

DESCRIPTION OF PREFERRED EMBODIMENTS

Figure 1:
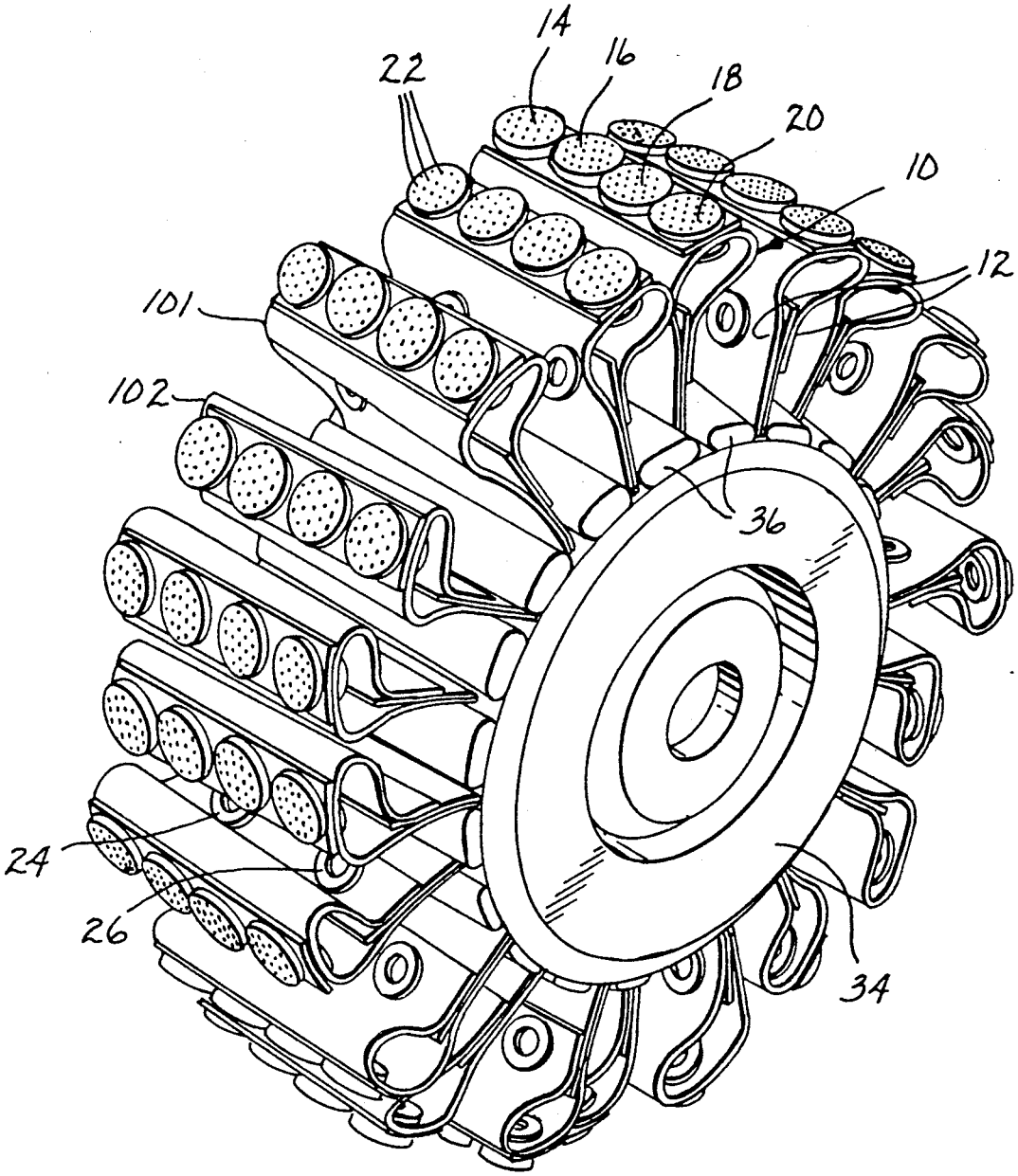
Fig. 1 (PRIOR ART)
FIG. 1 is a perspective view of a prior art roto-peening wheel utilizing a plurality of peening flaps, and which can have installed thereon any of a variety of embodiments of high-intensity peening flaps constructed in accordance with the present invention.

The elongate strap used in the flap constructions of the present invention is formed of a novel material having a high flexural endurance and shape retention sufficient to withstand the peening impact while retaining peening particle support bases thereon and to return the peening particles to position for further peening impacts. The novel material, preferred in the present invention, includes a fabric substrate or sheet material coated thereon with a plurality of coating layers, at least one coating layer including the linear polyurethane elastomer described above. The term "fabric" as used herein generally refers to a base substrate of fiber, yarn or other flexible material, whether random, non-woven, woven, knitted or braided, and upon which various polymers are applied by coating or calendaring.

Preferably, a combination of polymers and separate layers is used to form the coating. The most preferred polymer is a polycarbonate-polyether polyurethane. The most preferred polycarbonate-polyether polyurethane used as the linear polyurethane elastomer in one of the layers of the coating is the polycarbonate-polyether polyurethane sold under the trade name "Morthane CA-1225" (Morton International).

As previously stated, the preferred linear polyurethane is made from a mixture of a polycarbonate polyol and a polyether polyol, a diisocyanate compound, and first and second extenders. "Polyol" embraces alcoholic hydrocarbons having at least 2 hydroxyl groups. The polyether polyol and polycarbonate polyol can be used in any relative amounts provided that each are present in the composition. As noted above, the polyether polyol provides low temperature flexibility characteristics to the polyurethane, while the polycarbonate polyol imparts superior hydrolytic stability. It has been found convenient to use a polyether polyol:polycarbonate polyol ratio in the range of between about 2:1 to about 1:8.

Suitable polycarbonate polyols include those known under the trade names "Duracarb 120" and "Duracarb 122", aliphatic carbonates available from PPG Industries. Other useful polycarbonate polyols include those which are the polymerization product of bisphenol A and diphenyl carbonate, and the polymerization product of bisphenol A and carbonyl chloride, wherein the bisphenol A has hydroxyl groups substituted for one or more methyl hydrogens in each case to provide at least 2 hydroxyl functionalities. The molecular weight of the polycarbonate polyols preferably ranges from about 10,000 to 100,000, more preferably from about 45,000 to 65,000. The equivalent weight (molecular weight divided by OH number) preferably ranges from about 300 to 1000.

Suitable polyether polyols useful in the polyol mixture are addition products derived from cyclic ethers such as ethylene oxide, propylene oxide, tetrahydrofuran, and mixtures of these. The polyols known under the trade names "Polymeg 1000" and "Polymeg 2000" are poly(tetramethylene glyol) ethers available from QC Chemicals, and are especially preferred polyols. The molecular weight of the polyether polyols preferably ranges from about 10,000 to 100,000, more preferably from about 45,000 to 65,000. The equivalent weight of the polyether polyols preferably ranges from about 300 to 1100.

Generally, polyols having a molecular weight of between about 60 and 500 (and preferably less than about 250) have been found to be advantageous as extenders. Specific polyols useful as extenders include diols such as 1,3-butanediol, ethylene glycol, tripropylene glycol, dipropylene glycol, propylene glycol, and neopentyl glycol; triols such as trimethylol propane, as well as mixtures of these components, can be used. Amines, such as ethylene diamine can also be used as extenders.

Any diisocyanate compound is suitable, with those based on 4,4'-diphenyl methane diisocyanate (MDI) being preferred. The term "MDI" will be used throughout this application to designate diisocyanate compounds primarily based on 4,4'-diphenyl methane diisocyanate. The diisocyanate compound is initially reacted with one of the extenders which has a molecular weight of less than about 500 in a molar ratio of diisocyanate to extender of about 2:1 so as to form a modified diisocyanate component having a functionality of about 2 prior to reaction with the other components. The term "liquid MDI" will be used to designate an essentially difunctional modified MDI component prepared from the reaction of a low molecular weight polyol with an MDI component to form a modified diisocyanate composition which is liquid at room temperature (about 20° C.). Preferably, the modified diisocyanate is reacted sequentially, first with the polyol mixture, then with the second extender, so that a linear thermoplastic polyurethane elastomer is formed.

The relative amount of modified diisocyanate to polyol typically ranges from about 2:1 to 20:1, and preferably between about 2.5:1 and 8:1. The modified diisocyanate and the second extender enable the polymer to have low temperature processing properties of up to about 20° C. lower compared to those wherein the diisocyanate is not modified. This polymer has elastomeric characteristics and other physical properties which render it suitable for use in coated fabric manufacturing processes, and produces a coated fabric that is flexible, tough, tear resistant, resilient, and has a high flexural endurance as well as good shape retention.

Another preferred group of polymers which may be used as the coated fabric flap material of the flaps of this invention includes linear polyurethane elastomers formed by reacting a diisocyanate compound with an extender component having a molecular weight of 500 or less to form a modified diisocyanate component having a functionality of about 2, and then reacting the modified diisocyanate component with a polyol component and another extender component, either sequentially or together. These elastomers possess a unique, desirable combination of hydrolytic stability, toughness, and flexibility, and can be processed at lower temperatures compared to elastomers prepared from similar compositions wherein the components are reacted by a "one-shot" process or by a polyol-isocyanate prepolymer process. Further details on these elastomers and their preparation can be found in U.S. Pat. No. 5,013,811, the content of which is expressly incorporated herein by reference.

These polyurethanes may also be crosslinked by adding a crosslinking agent such as an organic isocyanate compound having an isocyanate functionality of at least 2 to increase the stiffness of the resulting coated fabric. Suitable organic isocyanate compounds include aromatic, aliphatic, and cycloaliphatic polyisocyanates and combinations thereof. Representative of these types are the diisocyanates such as m-phenylene diisocyanate, 2,4--toluene diisocyanate, 2,6-toluene diisocyanate, mixtures of 2,4- and 2,6-toluene diisocyanate, hexamethylene diisocyanate, tetramethylene diisocyanate, cyclohexane-1,4-diisocyanate, hexahydrotoluene diisocyanate (and isomers), naphthalene-1,5-diisocyanate, 1-methoxyphenyl-2,4-diisocyanate, MDI, 4,4'-biphenylene diisocyanate, 3,3-dimethoxy-4,4'-biphenyl diisocyanate, 3,3'-dimethoxy-4,4'-biphenyl diisocyanate, 3,3'-dimethyl-4,4'-biphenyl diisocyanate and 3,3'-dimethyldiphenylmethane-4,4'-diisocyanate; the triisocyanates such as 4,4',4''-triphenylmethane triisocyanate, and toluene 2,4,6-triisocyanate; and the tetraisocyanates such as 4,4'-dimethyldiphenylmethane-2,2', 5,5'-tetraisocyanate and polymeric polyisocyanates such as polymethylene polyphenylene polyisocyanate. Especially useful due to their availability and properties are toluene diisocyanate, MDI, and polymethylene polyphenylene polyisocyanate.

Other polymers may also be included in the coating, such as other polyurethanes or elastomers such as nitrile, natural or neoprene rubber. In the specific formulations described herein, a polyester polyurethane having a Shore A hardness of 90 or greater is preferred for use in combination with the polyurethane elastomers described above. In certain applications, multiple layers of that polyester polyurethane can be used to form the desired coating. The hardness of the polyester polyurethane is greater than what is normally used in conventional polyurethane top coats for coated fabrics, since flexibility is typically desired in conventional coated fabrics. In some high-intensity roto-peen applications, however, it has been found that a more rigid coated fabric is necessary to provide increased service life. Thus, harder polyester polyurethanes are used, and crosslinking agents may be included to further increase the stiffness of the final coated fabric used as the flap material. The resultant fabric is capable of providing a significantly increased service life compared to the softer, more flexible counterparts, as shown below in the Examples and in FIG. 5.

Moreover, any of the polyurethanes may be strengthened by adding a crosslinking agent, such as the organic isocyanate compounds having isocyanate functionality of at least 2, described above, to increase the stiffness of the resulting coated fabric. The overall stiffness or flexibility of the resulting fabric can therefore be varied by increasing or decreasing the number of layers utilizing crosslinked polyurethanes. Additionally, different layers of these polyurethanes are preferably utilized in the coated fabric to provide the correct combination of stiffness and mechanical properties, as explained in further detail below. When symmetrical layers and coating materials are provided on each side of the fabric substrate, the coated fabric is described as "balanced", while an "unbalanced" coated fabric would include a different number of layers, different coating materials, or different thicknesses in each side of the fabric thereof. It should be understood that both balanced and unbalanced coated fabrics used to form the peening flaps of the present invention are within the scope of this invention.

Coated fabrics utilize a fabric substrate to give the coated fabric integrity, as illustrated in FIG. 1 of copending application Ser. No. 07/788,653, filed on even date herewith, incorporated by reference herein, entitled "Fabric Structure for Severe Use Applications" The fabric material may include one or more layers or arrangements of fibers of various materials, weights, thicknesses and widths depending on the service life of peening flaps desired. The various configurations of fabric are generally known in the art and need not be explained in detail here. While the fabric providing the best mechanical properties required for the peening flap construction of the present invention has been found to be a woven nylon fabric, the invention is not limited to flaps made from any woven fabric, and encompasses flaps made from non-woven substrates as well. In addition, other natural or synthetic staple or non-staple fibers or yarns could be used in a mat, woven, knitted or braided configuration to form the fabric substrate.

When woven fabrics are to be used, polyester or fiberglass fibers or blends thereof are suitable, as well as nylon. Polyester fibers or fabrics have less moisture absorption and better long term heat aging compared to nylon, and would be preferred for applications requiring such properties. By testing the materials in accordance with the method described, infra, the best materials, structure, denier, etc. of the fibers or yarns for the fabric substrate can be determined for the particular peening operation.

Figure 2:
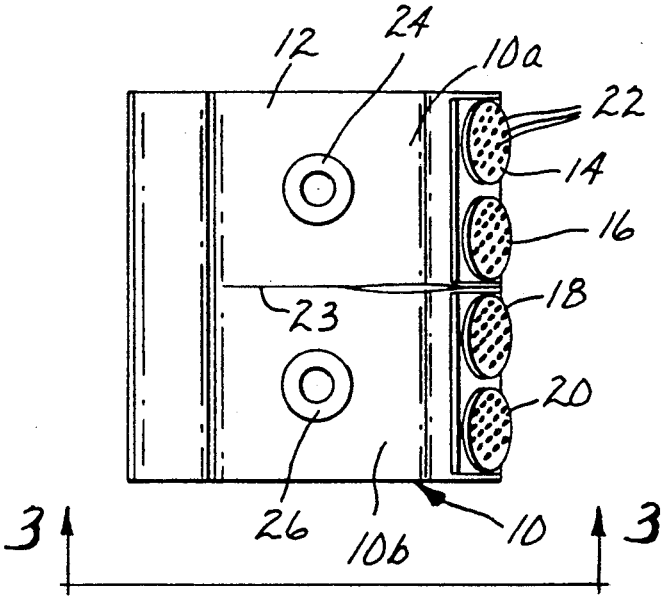
FIG. 2 is a plan view of one embodiment of a flap having structure in accordance with the present invention which incorporates the novel flap material.
Figure 3:
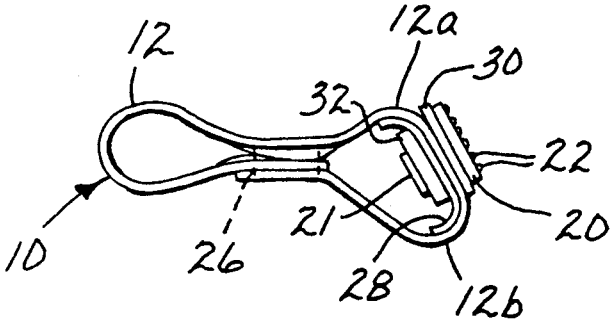
FIG. 3 is a side elevation view of the flap of FIG. 2 taken at line 3—3 of FIG. 2.
Figure 4:
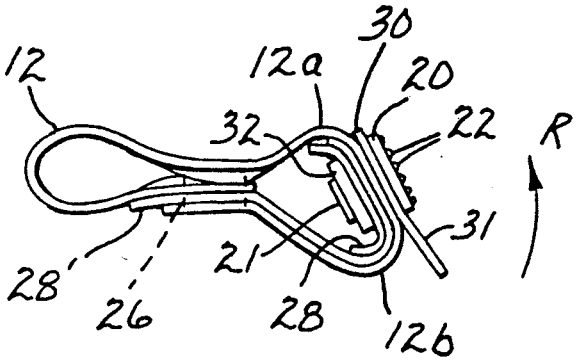
FIG. 4 is a side elevation view similar to FIG. 3 but showing another embodiment of the peening flap of the present invention.

For example, a two ply 840 denier high tenacity nylon 66 filament yarn woven into a basket weave construction consisting of about 34 warp (length direction) and about 34 weft (cross width direction) yarns has been found to provide the optimum mechanical properties of compression and density required for the fabric substrate of the high-intensity peening flaps shown in FIGS. 2–4. The weight of the uncoated fabric preferably ranges from about 180 to about 415 grams per square meter ("gsm"), preferably between 215–360 gsm and most preferably about 290 gsm. Also, the denier of the nylon yarn can vary over a range of about 400 to 1100, preferably about 600 to 1000, depending upon the number of warp and weft fibers. When rivet-type peening particle support bases are used, it has been found that a 21 warp by 21 weft, 840 denier, 175 gsm woven nylon fabric was insufficient, as was a 38 warp by 38 weft, 1050 denier, 420 gsm woven nylon fabric.

To the fabric substrate there is preferably applied a pretreatment chemical to aid in adhesion of subsequently applied coating layers. The pretreatment step can consist of applying an aziridine compound by, for example, a dipping process. A preferred aziridine compound is that sold under the trade name "CX-100", which is available from ICI Americas, Wilmington, DE.

The aziridine compound is mixed with an aqueous or organic solvent, such as water or toluene, in an amount of about 3 to 10 and preferably about 6 to 8 parts by weight solvent to 1 part aziridine, and the fabric is dipped into the mixture. Then, the wetted fabric is heated in an oven to a sufficient temperature to drive off the solvent. Generally, about 195° to 230° F. (90° to 110° C.) is sufficient, depending upon the specific solvent used.

It has also been found that coating adhesion to the fabric can be substantially increased by heating the aziridine wetted fabric to higher temperatures of at least about 300° to 350° F. (i.e. 150° to 170° C.). It is believed that such higher temperatures cause the aziridine ring to open and, thus, become much more reactive toward the subsequently applied coatings. When heated to these temperatures, an aziridine treated nylon fabric which is subsequently coated with a linear polyurethane elastomer exhibits at least about 100–200% improvement in peel strength (e.g., increases the peel strength from about 135 to about 270–410 Pa).

To the pretreated fabric substrate is provided a single or plurality of layers which each include one or more coatings of polymeric materials. The overall thickness of each of the layers will generally be sufficient to give a final coated fabric thickness of between about 0.05 cm and 0.15 cm. Individual layers can be calendered, although adhesion to the fabric may be slightly reduced as each individual layer increases in thickness. For optimum adhesion, the coated fabric thickness is built up in layers, with each layer being deposited in one or preferably a plurality of coatings of the desired polymeric material. Also, by depositing a plurality of coatings, it is possible to include the crosslinking agent in one or more of the coatings for increasing the stiffness of the fabric. The weight of the coated fabric preferably ranges from about 500 to 1500 gsm, more preferably from about 800 to 1200 gsm.

A preferred construction of the coated fabric material used in the flaps of this invention has a polyester polyurethane which contains a crosslinking agent, as the first layer adjacent each side of the pretreated fabric, followed by a layer of the preferred polycarbonate-polyether polyurethane (uncrosslinked) polycarbonate adjacent each polyester polyurethane layer.

Finally, a layer of polycarbonate-polyether polyurethane which contains a crosslinking agent is applied adjacent each uncross-linked polycarbonate-polyether polyurethane layer. The outermost layers can be a polyester polyurethane with or without the crosslinking agent.

If desired, any or all of layers can contain pigments, fillers, stabilizers, or other conventional additives at conventional levels normally found in this type of coating composition. It has been found that the addition of a small amount of a silicone compound, such as that sold under the trade name "L-42" (Union Carbide), has been found advantageous to increase the resiliency and tear strength of the overall fabric. This material is used in an amount of about 0.1 part to 2 parts based on 100 parts polymer, with 0.5 to 1 part being preferred. This enables the fabric to provide increased performance with respect to its ability to retain peening particle support bases upon the fabric under severe operating conditions.

While each layer may be composed of a different polymer composition, it is advantageous that at least one and preferably more than one layer contain the preferred polycarbonate-polyether polyurethane. Of course, several layers can contain this same polyurethane composition, either with or without the crosslinking agent, while other layers may contain any one of the different polymer materials described above. A preferred polyurethane material for one or more of the other layers is a polyester polyurethane having a durometer hardness of 90 Shore A or greater, such as the polyester polyurethanes known under the trade names "Estane 5707-F1" (B.F. Goodrich) or "Rucothane CO-A-5054" (Ruco Chemicals). Some layers of these other polyurethanes may also include an organic isocyanate compound having isocyanate functionality of at least 2 to form crosslinked polyurethanes. As noted above, the isocyanates are added to the polyurethanes to increase stiffness of the resulting composite structure. A wide variety of combinations of layers of different polyurethanes or other polymeric materials can be used, depending upon the particular application of the coated fabric. Also, as noted above, each layer is made from a plurality of coats of the desired material, or of mixtures of different but compatible polymeric materials.

The coated fabric can also be produced by calendaring the polymeric materials onto the fabric, where the individual components of each layer are initially prepared in sheet form and then are bonded together between rollers under heat and pressure. In this process, the crosslinking component is generally not included in the layers. When calendaring this material, the fabric substrate is initially coated with the aziridine compound and the first few layers of polymer on one side prior to calendaring the remaining layers to the initially coated fabric. Thereafter, the material can be turned over, and the other side of the substrate coated with the first few layers of polymer for the side, followed by the calendaring process to add the remaining layers to final dimension.

When using a calendaring process to apply the coatings to the fabric, it is advantageous to add a millable linear polyurethane elastomer having at least one pendant $$-\overset{|}{C}=\overset{|}{C}-\text{ group}$$

to lower the processing temperature of the coating material by at least about 6° C. A preferred material is the millable linear polyurethane elastomer sold under the trade name "Morthane CA-1217", although those sold under the trade names "Vibrathane V-5008" (Uniroyal Chemical), "Millathane HT" (TSE Ind.) and "Adiprene E" (Uniroyal Chemical) could also be used. The strength of the millable materials can be enhanced by adding a vulcanizing agent, preferably comprising sulfur and one or more sulfur compounds, and by vulcanizing the final product at conventional vulcanization temperatures (110°–140° C.).

Further description of the use of a millable elastomer to reduce the processing temperature can be found PCT application W090/11329 published Oct. 4, 1990. That application is expressly incorporated herein by reference thereto to the extent necessary to under stand this aspect of the invention.

Referring now to FIGS. 2 and 3, there is illustrated a first embodiment of a high-intensity peening flap, generally designated as 10, constructed in accordance with the present invention. Peening flap 10 comprises an elongate strap 12 having in this embodiment first and second overlapping ends fastened together by first fastening means (rivets) 24 and 26. The ends are also fastened to an intermediate portion of strap 12. Four peening particle support bases, 14, 16, 18 and 20 are typically provided which are aided in being retained on strap 12 by second fastening means (plastic or metal washers, one 32 being shown in FIGS. 3 and 4). A plurality of peening particles 22 are provided on the exposed face of each support base. In the FIG. 2 illustrated embodiment the peening particle support bases are mechanically fastened to strap 12 by being formed as a rivet having a head portion 20 and a shank 21, the rivets positioned between first and second elbows, 12*a* and 12*b*, of strap 12. Shank 21 is passed through an aperture in one layer of strap 12 (as well as through apertures in interior and exterior supports straps 28 and 30 and wear pads where provided). Washer 32 is then slipped over the rear of shank 21, and the rear of shank 21 is thereafter flared to securely fasten the support base to elongate strap 12.

Exterior strap 30 is positioned between a portion of the exterior surface of strap 12 and the non-exposed surface of support base 20. Similarly, internal support strap 28 is adjacent a portion of the interior surface of strap 12, between the interior surface and washer 32. Fastening rivets 24 and 26 are preferably positioned equidistant from a slit 23 in the strap 12 (thus creating sub-flaps 10*a* and 10*b*) and positioned generally on a line between support bases 14 and 16 (or 18 and 20) and parallel to the slit. The slit (or slits, if more than two sub-flaps are desired) allows peening action by supports 14 and 16 independent to that of peening supports 18 and 20.

Fastening rivets 24 and 26 secure the ends of elongate strap 12 to an intermediate portion of the elongate strap, thereby overlapping the ends of the strap. Other fastening means are conceivable, such as sonic welding, and are considered within the scope of the invention. It is also to be appreciated that the fastening of support bases 14, 16, 18 and 20 can succeed, rather than preceed, the fastening of strap ends to the intermediate portion of strap 12, although the preferred method attaches the supports first. Also, support bases 14, 16, 18, and 20 can be sonically welded to strap 12 rather than secured rivets.

The peening faces of the support bases are preferably inclined to the length of the strap at an acute angle, the angle ranging from about 25° to about 80°, more preferably ranging from about 45° to about 65°, as taught in U.S. Pat. No. 3,834,200, incorporated herein by reference.

In the case of rivet-type attachment, the material of the peening particle support bases 14, 16, 18, and 20 must be able to withstand high cyclic bending and impact stresses while resisting deformation during use. It is important to note that the bending and impact stresses during use are cyclic (i.e., repeated) since ultimate separation of head from shank of the rivets is the result of fatigue (cyclic stresses causing failure at lower stress levels than would ordinarily be expected). In addition, the rivet material must be sufficiently ductile to allow the required deformation to be cold formed and for fastening to the strap. When using previously known elongate strap materials with rivet-type support bases made from low carbon steel such as an AISI 1006 carbon steel it was found that the strap material required replacement prior to replacement of the rivets. However, with the use of linear polyurethane elastomers as coating material for the fabric scrim, the low carbon steel rivets have become the life limiting feature of the flaps used for high-intensity peening. The upper exposed surface of the low carbon steel becomes severely hardened during the brazing of the abrasive particles to the support bases. When a nickel (Ni) alloy brazing compound (described, infra) is used to attach abrasive particles to the rivets, the surface of the rivet that is exposed to the braze alloy is hardened as well as a region extending about 0.5 mm below this surface. The hardness of the rivet is more affected, however, by the lower carbon (C) content of low carbon steels, which is insufficient (under normal circumstances) to allow metallurgic transformation to a harder structure by heat treatment. This lower hardness may manifest itself in the abrasive peening particles being forced toward the center of the support base, creating a flattened surface profile, and consequently reducing the rate of scale or concrete removal during peening.

For this reason, peening particle support bases (prior to brazing) are preferably carbon steels having from about 0.08 to about 0.34 weight percent C, more preferably AISI 1021 steel (0.18–0.23 weight % C) having from about 0.0005% to about 0.003 by Weight boron (B) added thereto. 10B21 steel allows for hardening by heat treatment (via a metallurgical transformation), and exhibits good "hardenability", that is, it can be through hardened while 1006 cannot. It appears that 10B21 contains just enough C and B (preferably at least 0.002 wt% B) to be a hardenable alloy via heat treatment while having the maximum allowable C content to be formed using the current two stroke cold heading (forming) machine used to make the rivets, and the machine used to flare the shank of the rivets.

Tempering the rivets via heat treatment after brazing the abrasive particles thereto can affect hardness. Depending on the power and of type machine used to flare the shank of the rivet, the preferred center hardness is produced by adjusting the tempering temperature. A high tempering temperature (e.g. 700° C.) produces a hardness of about 70–100 HRB (Rockwell Hardness, B scale), while lowering the tempering temperature to about 400° C. produces hardness of about 30–40 HRC (Rockwell Hardness, C scale). Thus, one preferred tempering temperature ranges from about 375° C. to about 425° C., more preferably about 400° C., when a harder rivet is desired. A radial riveting machine known under the trade name "Baltec", available from Bracker Corporation, Pittsburg, PA, which uses a maximum riveting pressure of 1700 daN, may be used for rivets tempered at high temperatures, while low temperature tempering may require higher riveting pressures.

The peening particles are typically of a refractory-hard, impact fracture-resistant material, and they are metallurgically joined to the exposed face of the support bases 14, 16, 18, and 20. Refractory-hard cemented tungsten carbide shot known under the trade name "Grade 44A", available from Carboloy, Inc., of Detroit, MI, have been found to have an excellent combination of the preferred properties. This particular tungsten carbide includes a binder having from about 8–12 weight percent Co. However, other cemented carbides, for example, TiC and TaC; ceramic materials, for example, B<C and hot-pressed alumina as well as other wear-resistant, refractory-hard peening particles are also useful. The particle support bases and the peening particles must, of course, be compatible for metallurgical joining. Such bonding may be accomplished by brazing, casting the peening particles in place in the support base, sintering, or any other available method for forming the required bond. Preferred is brazing, using a brazing alloy having about 80–85% by weight Ni, about 3% B, about 7% Cr, about 3.5% Fe, about 4.5% Si, with traces of Al, C, Co, P, S, Se, Ti, and Zr. One commercially available brazing alloy meeting these specifications is that sold under the trade name "Amdry 770", a powder commercially available from Sulzer Plasma Technik, Inc., Troy, Michigan. This brazing alloy has 0.05% maximum Al; 2.75% minimum to 3.50% maximum B; 0.06 maximum C; 0.10 maximum Co; 5.0% minimum to 8.0 maximum Cr; 2.5% minimum Fe to 3.5 maximum Fe; 0.02% maximum P; 0.02 maximum S; 4.00% minimum to 5.00 maximum Si; 0.005 maximum Se; 0.05 maximum Ti; 0.05 maximum Zr; balance Ni. This brazing alloy has powder particle size distribution of 90% minimum at −140 mesh (−105 micrometers) and 50% maximum at −325 mesh (+45 micrometers).

Other braze alloys are possible for use but have limitations which make their use less than optimal. Copper braze alloys are limited by several factors, including their high fluidity, which could lead to infiltration of copper into the tungsten carbide shot. The vaporization temperature of liquid copper braze alloys is low enough in vacuum brazing furnaces so that argon atmospheres must be used. Silver braze alloys have poor mechanical properties and are not suitable for most abrasives applications. They also melt around 850° C. and would become remelted during subsequent heat treatment processes. Thus, nickel braze alloys are preferred. They are easy to use, having wide melting range, and become fully liquid at about 1000° C. because of the Si and B. These elements diffuse into the base metal or vaporize, however, and remelting requires a considerably higher temperature.

FIG. 4 illustrates a second preferred embodiment of a flap constructed in accordance with the present invention. Similar reference numerals are used in FIG. 4 to denote similar structural components of the embodiments of FIGS. 3 and 4. However, the embodiment shown in FIG. 4 differs in two significant respects from the embodiment of FIG. 3: the addition of a wear pad 28' and an extended portion of external support strap 30, referred to as fin 31. These features increase the life of the flap construction for excessively harsh operations such as concrete resurfacing. Wear pad 28' provides another layer of coated fabric, which may be composed of the same or different material as the elongate strap 12 materials discussed above. Preferably, wear pad 28' is composed of the preferred linear polyurethane elastomer coated nylon fabric, as described suora. Wear pad 28' is preferably sandwiched between internal support strap 28 and elongate strap 12, and follows the contour of strap 12 so that one end of wear pad 28' is sandwiched between the ends of strap 12, as shown in FIG. 4, although other structures are considered within the scope of the invention. For example, wear pad 28' could be placed externally, i.e., sandwiched between external support strap 30 and elongate strap 12, and follow the contour of strap 12 as would an internal wear pad. Shank 21 of pad 28' is external or internal.

Fin 31 is essentially an extension of upper support strap 30 on the trailing end (the flaps rotate in the direction indicated as "R" in FIG. 4). Tests under conditions deemed representative of actual use conditions have shown that the area generally designated as elbow **12*b* in FIGS. 3 and 4 has a tendency to wear excessively during high-intensity peening of concrete and other materials having an inclination to fragment under the pulverizing action of the peening particles. It was also theorized that when many flaps are loaded onto a hub, as shown in FIG. 1 which shows 20 flaps on one hub, the "tailgating" of the immediately succeeding flap against its leading neighbor flap causes a high wear area at 12*b* to form. Fin 31 interferes with this recoil, while wear pad 28' helps cushion the area adjacent elbow 12*b***, leading to longer flap life.

It is worthy to note that the features just presented may be combined to achieve optimum wear resistance of the flap. Some possible combinations include a "conventional" flap with the addition of the fin; fin plus internal wear pad; fin plus external wear pad; no fin but internal and external wear pad; etc. It is surmised that the best construction will depend on the operation, but at present is that having an external wear pad and a fin.

The flap constructions described above are ideally suited for use as the flaps in high-intensity roto peen devices such as the wheel shown and described in Minnesota Mining and Manufacturing Company product brochure 61-5000-5990-4(1282)11, published December 1988, reproduced in part in FIG. 1. A plurality of peening flaps constructed as described above, typically 20 flaps for a fully loaded 10.2 cm diameter hub, are attached to a hub 34 at attachment locations 36. At attachment locations 36, the looped ends of flaps 12 (opposite the area where the support bases are attached) are inserted into a slot along with a keeper pin, the pin and flap material combining to form a tight fit in the slots. Assembly details of wheel constructions such as these (other than the novel flaps described herein) are known and need not be described in detail herein. Product assembly instructions number 34-7017-9636-8 published December 1988, from Minnesota Mining and Manufacturing Company, St. Paul, MN, entitled "Heavy Duty Roto Peen Flap Wheel Assembly Instructions", describes in detail the assembly of such a wheel, and is incorporated herein by reference in its entirety. FIG. 1 shows that individual flaps 101 and 102 may be offset 0.635 cm, which is preferable, although not necessary, in such wheels to increase peening efficiency (i.e., decrease the time required to descale, finish, or stress relieve a surface).

EXAMPLES

The scope of the invention is further described in connection with the following examples which are set forth with the sole purpose of illustrating the embodiments of the invention and which are not to be construed as limiting the scope of the invention in any manner.

The following examples were prepared using one or more of the following compounds. In these examples, all parts given are by weight unless otherwise specified, and viscosities were measured using a Brookfield RF viscometer with #6 spindal at 20 rpm.

| Compound A | | |
|---|---|---|
| Component | Wet Weight | Dry Weight |
| Polyester Polyurethane (Known under the tradename Estane 5707-F1) | 50 | 50 |
| Fungicide (Known under the tradename Vinyzene BP 5-2) | 1 | 0.1 |
| Stabilizer (Known under the tradename Stabaxol P) | 1 | 1 |
| DMF (solvent) | 65 | 0 |
| THF (solvent) | 65 | 0 |
| Toluene (solvent) | 65 | 0 |

The DMF (dimethyl formamide), THF (tetrahydrofuran) and toluene solvents were combined, and the stabilizer and fungicide were added to the solvents and mixed well. The polyurethane was then added slowly with mixing until a uniform solution viscosity of about 3500 cps was obtained.

| Compound B | | |
|---|---|---|
| Component | Wet Weight | Dry Weight |
| Compound A | 100 | 20.69 |
| MDI polymeric isocyanate (Known under the trade- | 3.5 | 3.5 |

-continued

| Component | Compound B Wet Weight | Dry Weight |
|---|---|---|
| name PAPI 2027) | | |
| Silicone additive | 0.6 | 0.6 |

All components were mixed together and the viscosity was adjusted to 2500 cps with THF.

| Component | Compound C Wet Weight | Dry Weight |
|---|---|---|
| Polycarbonate-Polyether Polyurethane (Known under the trade-name Morthane CA-1225) | 62.3 | 62.3 |
| $TiO_2$ white pigment | 2.4 | 2.4 |
| Black pigment (Jet Black 2970) | 0.1 | 0.1 |
| Yellow iron oxide pigment | 3.6 | 3.6 |
| Terracotta iron oxide | 0.1 | 0.1 |
| Fumed Silica Filler known under the trade name OK 412 | 6.2 | 6.2 |
| Toluene (solvent) | 105 | 0 |
| DMF (solvent) | 70 | 0 |

The pigment, filler and solvents were mixed together and then the polycarbonate-polyether polyurethane was added. The components were mixed until all were completely in solution. The viscosity was then adjusted to 5500 cps with a 50/50 mixture of DMF and toluene.

| Component | Compound D Wet Weight | Dry Weight |
|---|---|---|
| Compound C | 100 | 29.9 |
| MDI polymeric isocyanate (Known under the trade-name PAPI 2027) | 2 | 2 |

The isocyanate component was added to compound C just before spreading.

| Component | Compound E Wet Weight | Dry Weight |
|---|---|---|
| Polyester Polyurethane (Known under the trade-name Estane 5707-F1) | 59 | 59 |
| antioxidant (Known under the trade-name Uvinul D-49) | 0.6 | 0.6 |
| fungicide (Known under the trade-name Vinyzene BP 5-2) | 1.2 | 0.12 |
| stabilizer (Known under the trade-name Stabaxol P) | 1.2 | 1.2 |
| Fumed Silica filler known under the trade name OK-412 | 5.9 | 5.9 |
| $TiO_2$ white pigment | 2.3 | 2.3 |
| Yellow iron oxide pigment | 3.4 | 3.4 |
| Black iron oxide pigment | 0.04 | 0.04 |
| Terracotta iron oxide pigment | 0.1 | 0.1 |
| DMF (solvent) | 88 | 0 |
| Toluene (solvent) | 88 | 0 |

The pigment, filler, stabilizer, fungicide and antioxidant were added to the solvent and mixed well. Then, the polyester polurethane was added and mixed until it was completely in solution. The viscosity was adjusted to 5500 cps with a 50/50 mixture of DMF/Toluene.

| Component | Compound F Wet Weight | Dry Weight |
|---|---|---|
| Aziridine | 6 | 6 |
| Toluene (solvent) | 100 | 0 |

These components were simply mixed together to form a solution.

EXAMPLE 1

A coated fabric was produced by taking the preferred 2 ply woven nylon fabric (basket weave) having a denier of 840 and a weight of 290 grams per square meter ("gsm") and coating it with the above described compounds in the following manner:

First Step: 3.59 gsm of fabric pretreatment compound F was applied to the fabric in a dip tank and passed through three ovens of a three head coater machine During this initial step the knife blades were not set and no material was applied by the coating heads. However, the coated fabric was passed through the three head coater machine at 9.14 meters per minute ("mpm") while the three zones of the first and second ovens were set at 160° C., 160° C., and 170° C., respectively and the four zones of the third oven were set at 160° C., 160° C., 170° C., L and 170° C., respectively.

The fabric was then wound on a roller and returned to again pass through the machine. One of the above described compounds was then applied by each of the three heads. For each subsequent pass of fabric through the machine, the three zones of the first and second ovens were set at 65° C., 80° C., and 110° C., respectively, and the four zones of the third oven were set at 65° C., 80° C., 110° C., and 110° C., respectively. Also, a knife blade having a thickness of 0.159 cm was used for the first coating head while a knife blade having a thickness of 0.318 cm was used for the second and third coating heads.

Second Step: The fabric was passed through the machine at 9.14 mpm. To the first side of the fabric 17.95 gsm of compound B was applied by both the first and second heads, and 17.95 gsm of compound E is applied by the third head. For this step, the knife at the first head was set so that it floats over the fabric, i.e., as in the floating knife embodiment described above, while the knives at the second and third heads were set over the roller.

Third Step The fabric was passed through the coater machine at 9.14 mpm and to the first side of the fabric 14.36 gsm of compound C was applied by both the first and the second heads, and 14.36 gsm of compound E was applied by the third head. During this step, the knife blades were set as in the second step.

Fourth Step The fabric was passed through the coater machine at 7.32 mpm to coat the second side of the fabric. 17.95 gsm of compound B was added by both the first and second heads and 14.36 gsm of compound E was applied by the third head. For this step, the knife blades were set as in the second step.

Fifth Step: The fabric was passed through the machine at 7.32 mpm to coat the second side of the fabric. 14.36 gsm of compound C was applied by both the first and second heads and 14.36 gsm of compound E was applied by the third head. For this and all subsequent steps, the knife blades were set over the rollers, i.e., as in the knife over roll embodiment described above.

sixth step: The fabric was passed through the machine at 7.32 mpm to coat the first side of the fabric. 14.36 gsm of compound C was applied by both the first and second heads and 14.36 gsm of compound E was applied by the third head.

Seventh Step: The fabric was passed through the machine at 7.32 mpm to coat the first side of the L fabric. 14.36 of compound C was applied by both the first and second heads and 14.36 gsm of compound E was applied by the third head.

Eighth step: The fabric was passed through the machine at 7.32 mpm to coat the second side of the fabric. 14.36 gsm of compound C was applied by both the first and second heads and 14.36 gsm of compound E was applied by the third head.

Ninth step: The fabric was passed through the machine at 7.32 mpm to coat the second side of the fabric. 14.36 gsm of compound C was applied by both the first and second heads and 14.36 gsm of compound E was applied by the third head.

Tenth Step: The fabric was passed through the machine at 7.32 mpm to coat the first side of the fabric. 14.36 gsm of compound C was applied by both the first and second heads and 14.36 gsm of compound E is applied by the third head.

Eleventh Step: The fabric was passed through the machine at 7.32 mpm to coat the first side of the fabric. 14.36 gsm of compound C was applied by both the first and second heads and 14.36 gsm of compound E was applied by the third head.

Twelfth Step: The fabric was passed through the machine at 7.32 mpm to coat the second side of the fabric. 14.36 gsm of compound C was applied by both the first and second heads and 14.36 gsm of compound E was applied by the third head.

Thirteenth Step: The fabric was passed through the machine at 7.32 mpm to coat the second side of the fabric. 14.36 gsm of compound C was applied by both the L first and second heads and 14.36 gsm of compound E was applied by the third head.

Fourteenth Step: The fabric was passed through the machine at 7.32 mpm to coat the first side of the fabric. 14.36 gsm of compound D was applied by both the first and second heads and 14.36 gsm of compound E was applied by the third head.

Fifteenth Step: The fabric was passed through the coating machine at 7.32 mpm to coat the first side of the fabric. 14.36 gsm of compound D was applied by both the first and second heads and 14.36 gsm of compound E was applied by the third head.

Sixteenth Step: The fabric was passed through the machine at 7.32 mpm to coat the second side of the fabric. 14.36 gsm of compound D was applied by both the first and second heads and 14.36 gsm of compound E was applied by the third head.

Seventeenth Step: The fabric was passed through the machine at 7.32 mpm to coat the second side of the fabric. 14.36 gsm of compound D was applied by both the first and second heads, and 4.36 gsm of compound E was applied by the third head.

The final coated fabric had a gauge of 0.094 cm $+0.005, -0.0025$ cm with a finished weight of 994 gsm.

It is believed that the polycarbonate-polyether polyurethane (sold under the trade name "Morthane CA-1225") layer provides flexibility, chemical resistance and compression properties to the coated fabric. The heat and abrasion resistance of the overall fabric is believed to be enhanced by the use of interleafing crosslinked layers of the polycarbonate-polyether polyurethane sold under the trade name "Morthane CA-1225" with the polyester polyurethane sold under the trade name "Estane 5707-F1".

EXAMPLES 2–13

Additional coated fabric samples were made using the same machine as in Example 1. Also, for each sample, an initial coating of Compound F and a total thickness was used as described in Example 1. For Examples 2–6, the fabric weight was 290 gsm. For Examples 2–12, steps 2–7 were applications of Formulation G: 100 parts of the polyester polyurethane sold under the trade name "Rucothane CO-A-5054", 3.5 parts of the isocyanate crosslinking agent sold under the trade name "Papi 2027", 0.5 part of the stabilizer sold under the trade name "Stabaxol", and 1.5 part X-Air (three steps on each side of the aziridine treated fabric). The remaining layers (steps 8–17) were applied as follows:

Example 2

All remaining steps applied Formulation B, five steps on each side, to form a balanced coating.

Example 3

Steps 12–17 were the same as Example 2. Steps 8–11 applied two steps of formulation A to each side of the fabric.

Example 4

Steps 8–17 applied Formulation D, five steps on each side of the fabric.

Example 5

Steps 12–17 were the same as Example 4 (i.e., three passes of Formulation D on each side of the substrate). Steps 8–11 applied 2 passes on each side of the substrate of Formulation C to improve the flexibility of the fabric.

Example 6

Same as Example 4 except that one side of the fabric has one pass (Step 8) of Formulation C. This creates an unbalanced coated fabric which has more flexibility than Example 4 but less than Example 5.

Examples 7–11 (Comparative)

Examples 2–6 were repeated, except that the uncoated fabric weight was 413 gsm, rather than 290 gsm.

Example 12

Example 4 was repeated, except that the uncoated fabric weight was 180 gsm, rather than 290 gsm.

Example 13

To a 180 gsm fabric substrate, two passes of Formulation G were applied (one on each side), followed by two passes of Formulation C (one on each side) and two passes of Formulation D (one on each side). Finally, both sides were calendered with an 0.028 cm film comprising an 80/20 blend of the polycarbonate-polyether polyurethane sold under the trade name "Morthane CA-1225" and the polyester polyurethane sold under the trade name "Morthane CA-1217". A vulcanizing agent consisting of 11.2 parts MBTS, 2.8 parts MBT, 4.2 parts sulfur and 1.4 part of the organic sulfur compound sold under the trade name "Caytur-4" was added to the polyester polyurethane during manufacture of the film. After calendaring, the fabric was subject to conventional vulcanizing temperatures to crosslink the film and improve the tensile strength of the coated fabric.

The relative performance of each of these coated fabrics was determined during a rotary peening test. The rotary peening test reveals the useful life of the strap material that can be expected in actual use. In the tests, a 15.24 cm hub was loaded with 40 peen flaps of the construction shown in FIGS. 2 and 3, with rivet-type peening particles supports made from AISI 1008 steel. A hub sold under the trade name "RX Hub", commercially available from Minnesota Mining and Manufacturing Company, St. Paul, MN, was loaded. The loaded hub was mounted on a lathe and driven at constant speed of 1750 rpm. Tests were performed by bringing the flap-loaded and rotating hubs in contact with a rotating 76.2 cm long low carbon steel pipe (2.54 cm wall thickness) mounted on a separate mount. The pipe was counter-rotated at 50 rpm and was mounted with its axis parallel to the axis of the loaded and rotating hub. The loaded and rotating hub was traversed back and forth (i.e., from end-to-end) across the pipe at a linear speed of 3.28 cm/min. The distance between the center of the flap wheel drive shaft and the pipe surface was 9.66 cm. The average hours for 50% peening particle support base (rivet) loss was recorded. The results are presented in Table 1.

TABLE 1

ROTO-PEENING TESTS OF STRAP MATERIALS

| Coated Fabric of example | Average hours for 50% Rivet loss |
|---|---|
| 1 | 100[a] |
| 2 | 58[b] |
| 3 | 56 |
| 4 | 67.5[b] |
| 5 | 69 |
| 6 | 74.5 |
| 7 | 35[b] |
| 8 | 47.5 |
| 9 | 41.5 |
| 10 | 61.5 |
| 11 | 63[a] |
| 12 | 74.5 |
| 13 | 71[a,c] |

[a]testing was discontinued with some samples not yet achieving a rivet loss of 50%.
[b]cracking occurred in the coating.
[c]delamination observed between the coating and fabric.

Coated fabric performance in these tests was measured by rivet loss during the rotary peening operation. A rivet loss of 50% was used as the point at which the useful life of the coated fabric was complete.

Prior coated fabric materials for similar rotary peening applications exhibited a maximum useful life of only about 10 to 15 operational hours for a polyester polyurethane coated, 180 gsm, 840 denier fabric, such as the polyester-polyurethane coated nylon sold under the trade name "Reevecoat 7625" mentioned above. The coated fabric of Example 1 provided over 100 hours of useful service before testing was discontinued. Since rivets made from low carbon steels typically have a useful life of only about 110 to 115 operational hours, that fabric provides essentially equivalent performance to that of the rivets. The coated fabric of Example 1 thus provided optimum performance in this application. Since the prior art, such as the coated fabric sold under the trade name "Reevecoat 7625," mentioned above, was capable of achieving a maximum of only about 10 to 15 hours service, other coated fabric constructions of the invention are advantageous even though a service life of about 35 to 75 hours was obtained, because this is a substantial improvement over the prior art.

Figure 5:
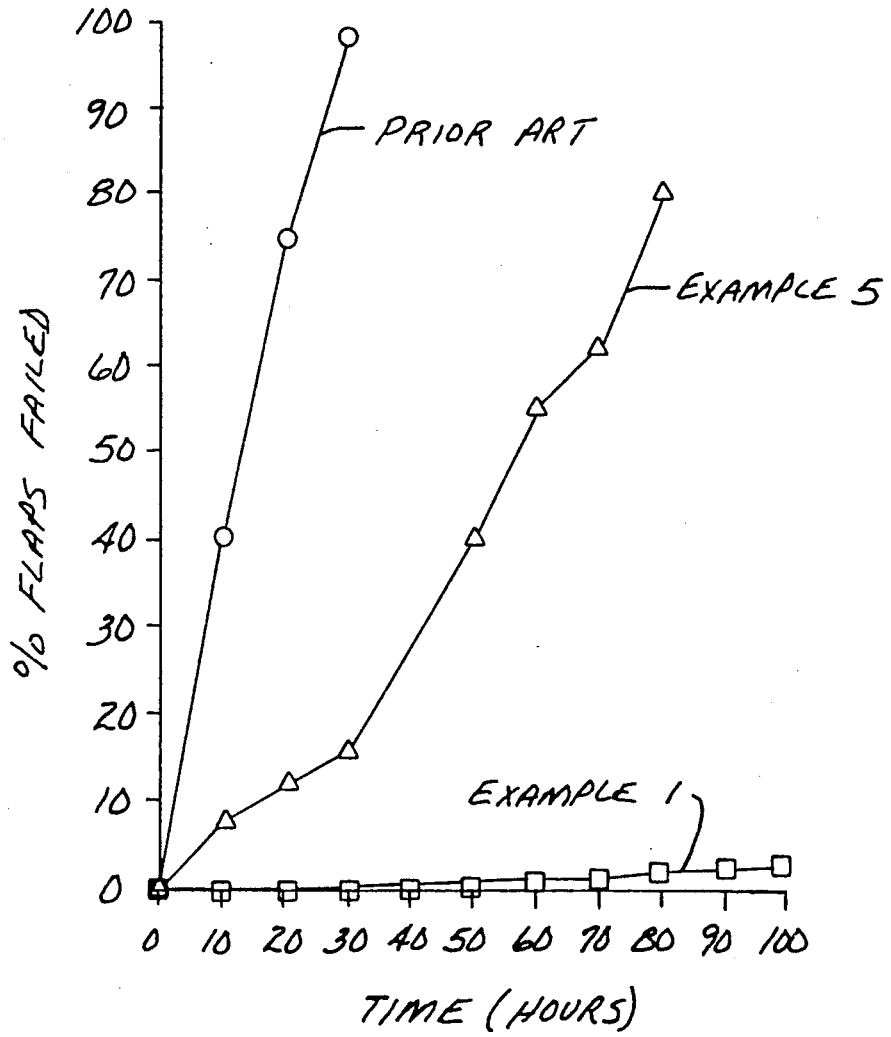
FIG. 5 is a graphical representation of test results of a flap peening test wherein peening flaps containing various coated fabrics were evaluated.

These results are graphically illustrated in FIG. 5. The curve labeled "Prior Art" is for tests of flaps made using the nylon fabric coated with the polyester-polyurethane sold under the trade name "Reevecoat 7625". The middle curve illustrates the performance of flaps made using the coated fabric of Example 5, while the curve labeled "Example 1" shows the dramatic improvement for flaps utilizing the most preferred fabric construction according to the invention. As noted above, however, flaps constructed using the formulations illustrated by the middle curve also provided substantial improvement over the prior art.

Examples 14–17

Tests were carried out using various flap constructions to determine whether structural modifications to the flap would improve useful life of the flaps. The constructions tested are presented, along with the % rivet loss after 80 hours of peening, in Table 2. For each of examples 14–17 the elongate strap, internal and external support straps, wear pad, and fins were made using the coated fabric of Example 1. The test apparatus described above was used, and although other rivet materials were tested, Examples 14–17 all used AISI 1006 steel rivets.

TABLE 2

ROTO-PEENING TESTS OF VARIOUS FLAP CONSTRUCTIONS

| Example | Construction | % Rivets Lost After 80 Hours |
|---|---|---|
| 14 | elongate strap, square internal and rectangular external support straps, 3 flaps having 4 rivets each | 50 |
| 15 | elongate strap, oval internal and rectangular external support straps, 5 flaps having 4 rivets each | 50 |
| 16 | elongate strap, one square internal and two rectangular external support straps, 10 flaps each having 4 rivets | 25 |
| 17 | elongate strap, one internal wear pad, rectangular external support straps, square internal support strap, fin, 4 flaps each having 4 rivets | 6* |

*measured after 70 hours

Note from Table 2 that the use of two support straps (one internal, one external) (Example 15) allowed five flaps to achieve the same useful life as three flaps (Example 14). "Oval" internal support strap refers to the shape of the strap, as does "rectangular" external; support strap. The addition of one internal and two external support straps (Example 16) allowed ten flaps to achieve double useful life over the three flaps of Example 14. Finally, the combination of structural improvements in Example 17 allows a substantial improvement in useful life over the flaps of Example 14, which was surprising since more flaps were used on the wheel.

What is claimed is:

1. An improved high-intensity peening flap of the type in which an elongate strap of fabric having a coating thereon has at least one peening particle support base fastened thereto, the support base having a plurality of peening particles joined to an exposed face of the support base, wherein the improvement comprises said coating comprising a plurality of coating layers, at least one of the layers being comprised of a linear polyurethane elastomer.

2. The peening flap of claim 1 wherein the linear polyurethane elastomer is formed from a polyol; a diisocyanate compound; a first extender component having a molecular weight of below about 500; and a second extender component; wherein the diisocyanate compound is initially reacted with the first extender component in a molar ratio of diisocyanate to first extender component of about 2:1 to form a modified diisocyanate having a functionality of about 2 prior to reaction with the polyol and second extender component to provide relatively low temperature processing properties to the linear polyurethane elastomer.

3. The peening flap of claim 2 wherein the polyol is a mixture of polyether polyol and polycarbonate polyol.

4. The peening flap of claim 1 wherein one or more of the coating layers includes a silicone compound.

5. The peening flap of claim 1 wherein at least one coating layer includes a crosslinked linear polyurethane elastomer.

6. The peening flap of claim 1 further comprising a pretreatment chemical applied upon at least a portion of the fabric to aid in the bonding of the coating layers thereto.

7. The peening flap of claim 1 wherein at least one of the coating layers includes a second polymer.

8. The peening flap of claim 7 wherein said second polymer is a crosslinked polyester polyurethane.

9. The peening lap of claim 7 wherein said second polymer comprises an elastomer selected from the group consisting of natural, nitrile, and neoprene rubber.

10. The peening flap of claim 1 wherein the fabric has an uncoated weight between about 180 and about 415 gsm.

11. The peening flap of claim 10 wherein the fabric is woven from yarn or fiber which is comprised of a polymer selected from the group consisting of nylon and polyester.

12. The peening flap of claim 1 wherein the plurality of coating layers includes an outermost crosslinked layer of polyurethane.

13. The peening flap of claim 1 wherein one or more coating layers comprise a second polymer of a polyester polyurethane having a Shore A hardness of 90 durometer or greater.

14. An improved high-intensity peening flap of the type in which an elongate strap of fabric having a coating thereon has at least one peening particle support base fastened thereto, the support base having a non-exposed face and a plurality of peening particles joined to an exposed face of the support base, wherein the improvement comprises, said elongate support strap having first and second ends, an intermediate portion between said ends, and adapted to have external and internal surfaces when said first and second ends are overlapped, said strap folded so that the respective ends of said strap overlap and are each fastened to said intermediate portion of the strap by first fastening means, said intermediate portion of the strap forming first and second elbow portions of the strap, the peening particle support base secured to the strap between said first and second elbow portions so that said non-exposed face of said peening particle support base is adjacent the external surface of the strap using second fastening means, said flap also having exterior and interior support straps, said exterior support strap positioned adjacent a portion of said exterior surface of the elongate strap, said exterior support strap sandwiched between said portion of said exterior surface and said non-exposed surface of said peening particle support base, said interior support strap adjacent a portion of an interior surface of the elongate strap, said interior support strap positioned between said portion of said interior surface of said strap and said second fastening means.

15. The peening flap of claim 14 wherein the exterior support strap has an extended fin, said extended fin extending toward the trailing end of the flap.

16. The peening flap of claim 14 which further includes a wear pad, said wear pad positioned generally adjacent a portion of the interior surface of the elongate strap extending from said first fastening means to said second fastening means.

17. The peening flap of claim 16 wherein said wear pad comprises a coated fabric having the same construction as the elongate strap.

18. The peening flap of claim 14 which further includes a wear pad, said wear pad positioned generally adjacent a portion of the exterior surface of the elongate strap extending from said first fastening means to said second fastening means.

19. The peening flap of claim 18 wherein said wear pad comprises a coated fabric having the same construction as the elongate strap.

20. The peening flap of claim 14 wherein the exterior support strap has an extended fin, said fin extending toward the trailing end of said flap, said flap further comprising a wear pad positioned generally adjacent a portion of the interior surface of the elongate strap extending from said first fastening means to said second fastening means.

21. The peening flap of claim 20 wherein the wear pad comprises a coated fabric of the same construction as the elongate strap.

22. The peening flap of claim 14 having at least two peening particle support bases, said elongate strap having at least one slit which forms two or more independent sub-flaps on which the peening particle support bases are fastened by respective second fastening means.

23. The peening flap of claim 20 having at least two peening particle support bases, said elongate strap having at least one slit which forms two or more independent sub-flaps on which the peening particle support bases are fastened by respective second fastening means.

24. An improved rotary peening wheel of the type having a hub, at least one peening flap removably fastened to the hub, the flap including an elongate strap of fabric having a coating thereon, the strap having at least one metal peening particle support base fastened thereto, and a plurality of peening particles metallurgically joined to an exposed face of the support base, wherein the improvement comprises the coating comprising a plurality of coating layers, at least one of the layers being comprised of a linear polyurethane elastomer.

25. The wheel of claim 24 wherein the linear polyurethane elastomer is formed from a polyol; a diisocyanate compound; a first extender component having a molecular weight of below about 500; and a second extender component; wherein the diisocyanate compound is initially reacted with the first extender component in a molar ratio of diisocyanate to first extender component of about 2:1 to form a modified diisocyanate having a functionality of about 2 prior to reaction with the polyol and second extender component to provide relatively low temperature processing properties to the linear polyurethane elastomer.

26. The wheel of claim 25 wherein the polyol is a mixture of polyether polyol and polycarbonate polyol.

27. The wheel of claim 24 wherein one or more of the coating layers includes a silicone compound.

28. The wheel of claim 24 wherein at least one coating layer includes a crosslinked linear polyurethane elastomer.

29. The wheel of claim 24 further comprising pretreatment chemical applied upon at least a portion of the fabric to aid in the bonding of the coating layers thereto.

30. The wheel of claim 24 wherein at least one of the coating layers includes a second polymer.

31. The wheel of claim 30 wherein said second polymer is a crosslinked polyester polyurethane.

32. The wheel of claim 30 wherein said second polymer comprises an elastomer selected from the group consisting of natural, nitrile, and neoprene rubber.

33. The wheel of claim 24 wherein the fabric has an uncoated weight between about 180 and about 415 gsm.

34. The wheel of claim 33 wherein the fabric is woven from yarn or fiber which is comprised of a polymer selected from the group consisting of nylon and polyester.

35. The wheel of claim 24 wherein the plurality of coating layers includes an outermost crosslinked layer of polyurethane.

36. The wheel of claim 24 wherein one or more coating layers comprise a second polymer of a polyester polyurethane having a Shore A hardness of 90 durometer or greater.

37. The wheel of claim 24, said elongate strap having first and second ends, said strap folded so that the respective ends of said strap overlap and are each fastened to an intermediate portion of the strap by first fastening means, the peening particle support base secured to the strap between first and second elbow portions of the strap using second fastening means, said flap also having exterior and interior support straps, said exterior support strap positioned adjacent a portion of an exterior surface of the elongate strap, said exterior support strap sandwiched between said portion of said exterior surface and a non-exposed surface of said peening particle support base, said interior support strap adjacent a portion of an interior surface of the elongate strap, said interior support strap positioned between said portion of said interior surface of said strap and said second fastening means.

38. The wheel of claim 37 wherein the exterior support strap has an extended fin, said extended fin extending toward the trailing end of the flap.

39. The wheel of claim 37 which further includes a wear pad, said wear pad positioned generally adjacent a portion of the interior surface of the elongate strap extending from said first fastening means to said second fastening means.

40. The wheel of claim 39 wherein said wear pad comprises a coated fabric having the same construction as the elongate strap.

41. The wheel of claim 37 wherein the exterior support strap has an extended fin, said fin extending toward the trailing end of said flap, said flap further comprising a wear pad positioned generally adjacent a portion of the interior surface of the elongate strap extending from said first fastening means to said second fastening means.

42. The wheel of claim 41 wherein the wear pad comprises a coated fabric of the same construction as the elongate strap.

43. The wheel of claim 37 having at least two peening particle support bases, said elongate strap having at least one slit which forms two or more independent sub-flaps on which the peening particle support bases are fastened by respective second fastening means.

44. The wheel of claim 41 having at least two peening particle support bases, said elongate strap having at least one slit which forms two or more independent sub-flaps on which the peening particle support bases are fastened by respective second fastening means.

45. A method of making a rotary peening flap, said method comprising:

(a) fastening at least one peening particle support base to an elongate strap of fabric having a coating thereon, the elongate strap having first and second ends and an intermediate portion between said first and second ends, the coating having a plurality of coating layers, at least one of the layers comprising a linear polyurethane elastomer; and (b) overlapping and fastening said first and second ends to said intermediate portion of said elongate strap with fastening means, thus forming interior and exterior strap surfaces.

46. Method accordance with claim 45 wherein said linear polyurethane elastomer is formed from a polyol; a diisocyanate compound; a first extender component having a molecular weight of below about 500; and a second extender component; wherein the diisocyanate compound is initially reacted with the first extender component in a molar ratio of diisocyanate to first extender component of about 2:1 to form a modified diisocyanate having a functionality of about 2 prior to reaction with the polyol and second extender component to provide relatively low temperature processing properties to the linear polyurethane elastomer.

47. Method in accordance with claim 45 wherein prior to fastening said peening particle support base to said elongate strap, exterior and interior support straps are positioned adjacent portions of said exterior and interior strap surfaces of said elongate strap, respectively, and generally where said peening particle support base is fastened.

48. Method in accordance with claim 47 wherein, prior to positioning said interior support strap, a wear pad is positioned adjacent to said interior surface of the elongate strap, said interior surface elongate strap, the slit positioned generally parallel to the long axis of the elongate strap.

49. Method in accordance with claim 48 wherein said external support strap has a trailing fin.

50. Method in accordance with claim 45 wherein said peening particle support base comprises a base material and a nickel-enriched layer, said base material consisting essentially of from about from about 0.08 to about 0.34 percent by weight carbon, and the balance iron.

51. Method in accordance with claim 45 wherein prior to step (a) at least one slit is cut in said strap, the slit having a length less than the length of the elongate strap, the slit positioned generally parallel to the long axis of the elongate strap.

52. An improved method of high-intensity rotary peening of surfaces using a rotary peening wheel, the wheel including a hub loaded with at least one peening flap said flap comprising an elongate strap of fabric having a coating thereon, the coating being a plurality of coating layers, at least one of the coating layers being comprised of linear polyurethane elastomer, the strap having at least one metal peening particle support base fastened thereto, and a plurality of peening particles metallurgically joined to an exposed face of the support base, wherein the method comprises rotating said hub in a manner which forcefully contacts said plurality of peening particles against the workpiece.

53. Method in accordance with claim 52 wherein said linear polyurethane elastomer is formed from a polyol; a diisocyanate compound; a first extender component having a molecular weight of below about 500; and a second extender component; wherein the diisocyanate compound is initially reacted with the first extender component in a molar ratio of diisocyanate to first extender component of about 2:1 to form a modified diisocyanate having a functionality of about 2 prior to reaction with the polyol and second extender component to provide relatively low temperature processing properties to the linear polyurethane elastomer.

54. Method in accordance with claim 53 wherein said polyol is a mixture of polyether polyol and polycarbonate polyol.

55. Method in accordance with claim 52 wherein said at least one flap includes interior and exterior support straps positioned adjacent interim and exterior surfaces of said elongate strap, respectively, and generally where said peening particle support base is fastened.

56. Method in accordance with claim 55 wherein said at least one flap includes a wear pad positioned adjacent the interior surface of the elongate strap and between said interior surface and said interior support strap.

57. Method in accordance with claim 56 wherein said external support strap includes a trailing fin.

58. Method in accordance with claim 55 wherein said at least one metal peening particle support comprises a base material and a nickel enriched layer, said and said base consists essentially of from about from about 0.08 to 0.34 percent by weight carbon, and the balance iron.

59. Method in accordance with claim 56 wherein said at least one metal peening particle support comprises or base material and a nickel enriched layer, and said base material consists essentially of from about from about 0.08 to 0.34 percent by weight carbon, and the balance iron.

60. Method in accordance with claim 57 wherein said at least one metal peening particle support comprises or base material and a nickel enriched layer, and said base material consists essentially of from about from about 0.08 to 0.34 percent by weight carbon, and the balance iron.

61. The peening flap of claim 14 wherein said elongate strap, exterior and interior support straps are of same construction, and wherein said coating comprises a plurality of coating layers, at least one of the layers being comprised of a linear polyurethane elastomer.

62. The peening flap of claim 61 further including wear pad having the same construction as the elongate strap, said wear pad positioned adjacent an interior portion of said strap.

63. The peening flap of claim 61 further including a wear pad having the same construction as the elongate strap, and positioned adjacent an exterior portion of said strap.

* * * * *

UNITED STATES PATENT AND TRADEMARK OFFICE

CERTIFICATE OF CORRECTION

PATENT NO. : 5,203,189

DATED : April 20, 1993

INVENTOR(S) : Michael W. Lovejoy

It is certified that error appears in the above-indentified patent and that said Letters Patent is hereby corrected as shown below:

| | |
|---|---|
| Col. 12, line 44 | "B<C" should be --$B_4C$-- |
| Col. 13, line 34 | "suora" should be --supra-- |
| Col. 13, line 44 | "Shank 21 of pad 28′ is external or internal." should be --Shank 21 of rivet 20 passes through an aperture in pad 28′ whether pad 28′ is external or internal.-- |
| Col. 16, line 29 | "170°C., L and" should be --170°C., and-- |
| Col. 17, line 9 | "L fabric" should be --fabric-- |
| Col. 17, line 41 | "L first" should be --first-- |
| Col. 17, line 61 | "4.36 gsm" should be --14.36 gsm-- |
| Col. 19, line 27 | "9.66 cm" should be --8.66 cm-- |

UNITED STATES PATENT AND TRADEMARK OFFICE

CERTIFICATE OF CORRECTION

PATENT NO. : 5,203,189

DATED : April 20, 1993

INVENTOR(S) : Michael W. Lovejoy

It is certified that error appears in the above-indentified patent and that said Letters Patent is hereby corrected as shown below:

Col. 24, lines 51-53 "said interior surface elongate strap, the slip positioned generally parallel to the long axis of the elongate strap." should be --said surface being from said peening particle support base to said fastening means.--

Signed and Sealed this

Ninth Day of August, 199

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,203,189

DATED : April 20, 1993

INVENTOR(S) : Lovejoy et al

It is certified that error appears in the above-indentified patent and that said Letters Patent is hereby corrected as shown below:

On the title page: Item [54] and Column 1,line 2

HIGH-INTENSITY ROTO PEEN....." should be --IMPROVED HIGH-INTENSITY ROTO PEEN.....--.

Item [73] Assignee

"Minnesota Mining and Manufacturing Company, St. Paul, Minn." should be --Minnesota Mining and Manufacturing Company, St. Paul, Minn. and Reeves Brothers Inc., Spartanburg, South Carolina--

Col. 12, line 44 "B<C" should be --$B_4C$--

Col. 13, line 34 "suora" should be --supra--

Col. 13, line 44 "Shank 21 of pad 28′ is external or internal." should be --Shank 21 of rivet 20 passes through an aperture in pad 28′ whether pad 28′ is external or internal.--

UNITED STATES PATENT AND TRADEMARK OFFICE

CERTIFICATE OF CORRECTION

PATENT NO. : 5,203,189

DATED : April 20, 1993

INVENTOR(S) : Lovejoy et al

It is certified that error appears in the above-indentified patent and that said Letters Patent is hereby corrected as shown below:

Col. 16, line 29 "170°C., L and" should be --170°C., and--

Col. 17, line 9 "L fabric" should be --fabric--

Col. 17, line 41 "L first" should be --first--

Col. 17, line 61 "4.36 gsm" should be --14.36 gsm--

Col. 19, line 27 "9.66 cm" should be --8.66 cm--

Col. 24, lines 51-53 "said interior surface elongate strap, the slip positioned generally parallel to the long axis of the elongate strap." should be --said surface being from said peening particle support base to said fastening means.--

Signed and Sealed this

Eighteenth Day of October, 1994

*Attest:*

Bruce Lehman

BRUCE LEHMAN

*Attesting Officer*

*Commissioner of Patents and Trademarks*